United States Patent [19]

Marrero

[11] 4,080,518

[45] * Mar. 21, 1978

[54] MULTI-MODE SWITCH ASSEMBLY AND ELECTRICAL OUTLET

[76] Inventor: Louis Marrero, 1209 Via Ramon, Escondido, Calif. 92025

[ * ] Notice: The portion of the term of this patent subsequent to Apr. 27, 1993, has been disclaimed.

[21] Appl. No.: 685,045

[22] Filed: May 10, 1976

[51] Int. Cl.[2] ..... H01R 13/70

[52] U.S. Cl. ..... 200/51 R; 200/6 BB; 200/16 R; 200/77; 200/153 LA

[58] Field of Search ..... 200/16 R, 6 BB, 5 R, 200/5 B, 5 E, 6 R, 6 B, 51 R, 153 L, 153 LA, 77, 339, 329, 330; 339/122 F; 174/57

[56] References Cited

U.S. PATENT DOCUMENTS

| | | | |
|---|---|---|---|
| 2,824,180 | 2/1958 | Carver | 200/16 R |
| 3,217,112 | 11/1965 | Campbell et al. | 200/339 X |
| 3,221,115 | 11/1965 | Feher, Jr. | 200/77 X |
| 3,260,802 | 7/1966 | Yamauchi et al. | 200/5 E |
| 3,324,260 | 6/1967 | Schumacher | 200/51 R |
| 3,953,689 | 4/1976 | Marrero | 200/16 R X |

*Primary Examiner*—James R. Scott
*Attorney, Agent, or Firm*—Ralph S. Branscomb

[57] ABSTRACT

The invention comprises a combination electrical outlet and switch assembly characterized by a rocker-type actuator pivoted to the front of a wiring box, and a pair of sliding cam bars are pivoted to one end of the rocker and have non-linear or "programmed" surfaces which slide in biased relation across a pair of switch contacts to open and close same, these cam bars being arrangeable in several different ways, and being usable on two separate rockers to achieve several different switching modes in the same basic assembly. The outlet portion of the box includes three conductive elements adapted to receive the prongs of an electrical plug and having connector means comprising sleeves mounted within a casing of the wiring box by simply inserting stripped wires into the sleeve. The completed wiring box is adjustable forwardly and rearwardly in a special bracket to permit aligning the front plane of the assembly flush with the exposed surface of newly installed wall board.

14 Claims, 15 Drawing Figures

MULTI-MODE SWITCH ASSEMBLY AND ELECTRICAL OUTLET

BACKGROUND OF THE INVENTION

The invention is in the field of wall switches, electrical outlets, and combinations thereof.

A number of different switch assemblies and outlets have been conceived, including three U.S. Pat. Nos. issued to applicant, Nos. 4,035,052, 3,928,716, and 3,953,689, the last of these being a combination outlet and switch assembly utilizing a sliding toggle plate structure having ribs contoured to alternately depress and release a pair of switching contacts. Although this apparatus provided a versatility in switching modes previously unknown in the art, it does leave some room for simplification both from a manufacturing point of view and the standpoint of onsight installation and operation.

SUMMARY OF THE INVENTION

The present invention is basically a modification of the Convertible Switch Outlet Assembly disclosed in the abovementioned patent applicaton bearing Ser. No. 515,298 now U.S. Pat. No. 3,953,689. Whereas that assembly utilized one or more sliding plates to operate the switch elements, the instant invention provides one or two rocker arms centrally pivoted to the front face of a wiring box and a pair of sliding cam bars pivoted to the rocker structure such that displacement of the rocker causes the cam bars to slide against and actuate tabs extending from movable switch contacts. The cam bars are structures such that they may be made to interlock and move simultaneously when pivoted to a single rocker arm, or rearranged for independent operation by a pair of rocker arms, and the switchcontacting surfaces of the cam bars are contoured such that by rearranging the bars several different simultaneous and independent switching modes can be achieved.

The electrical outlet structure comprises three singlepiece conductive elements which are shaped to both receive the bayonet prongs of an electrical plug from the front and, by means of multiple sleeves defined rearwardly in each conductive element, receive power wires, ground wires, and wires leading to other outlet boxes from behind, the conductive elements being seated in insulating cups projecting forwardly from a wall in the wiring box, this wall having a bore aligned with each sleeve such that upon insertion of the bared ends of wires through the bores, intimate electrical contact is made with the sleeves.

DETAILED DESCRIPTION OF THE PREFERRED EMBODIMENT

Figure 1:
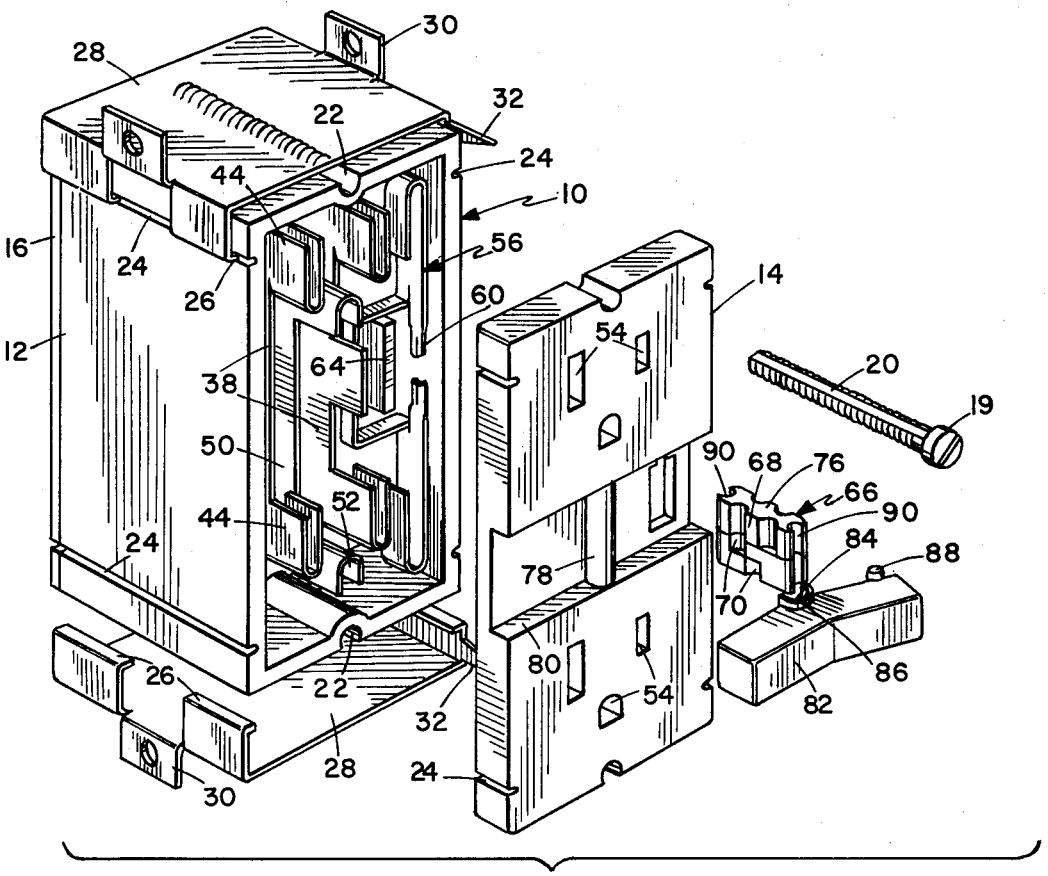
FIG. 1 is an exploded perspective view of the outlet assembly.
Figure 6:
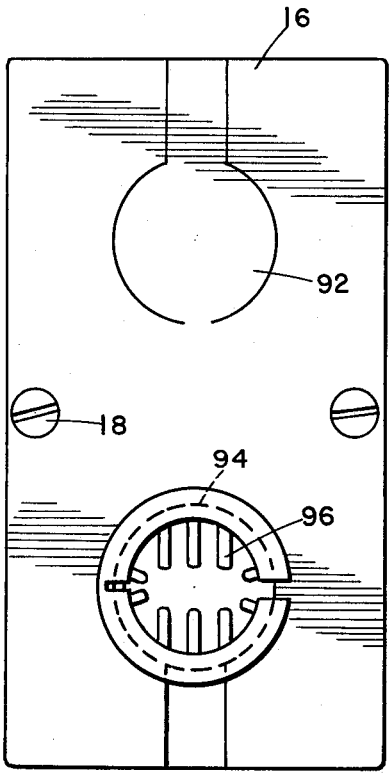
FIG. 6 is a rear view of the outlet box.

The apparatus is shown in exploded form in FIG. 1 and includes what will be generally termed a wiring box 10 which comprises a casing 12, a front plate 14, and a rear plate 16 shown in plan view in FIG. 6. When the wiring box is completely assembled as best shown in FIG. 4, the rear plate 16 is attached to the casing such as by screws 18 which thread into thickened portions of the side walls of the casing, and the front plate 14 is similarly fastened to the front of the casing by means of screws 19 which preferably have a flat side 20 and engage in threaded channels 22 which define more than 180° in cross section.

When the wiring box is so assembled, the components thereof define continuous slots 24 which receive in sliding relationship track-forming edges 26 of a pair of mounting brackets 28. These mounting brackets each have a pair of opposed, upstruck flanges 30 having holes therein so that the brackets may be mounted against either side of an upright stud behind a wall board. Thus after these brackets have been mounted, the wiring box 10 is free to slide forwardly and rearwardly along the track 26 provided the screws 19 are oriented with their flat sides toward the bracket, and a twist of these screws will secure the wiring box against sliding. The mounting brackets are provided with spikes 32 so that the wiring box can be installed, fully wired, with the front of the brackets flush with the front of a stud, and the spikes will project through subsequently installed wall board to indicate the outlet location so that an opening may be cut in the wall board subsequent to the installation thereof to permit the drawing of the wiring box out to a position flush with the exposed surface of the wall board and secured in this position by a twist of the screws 18.

Figure 2:
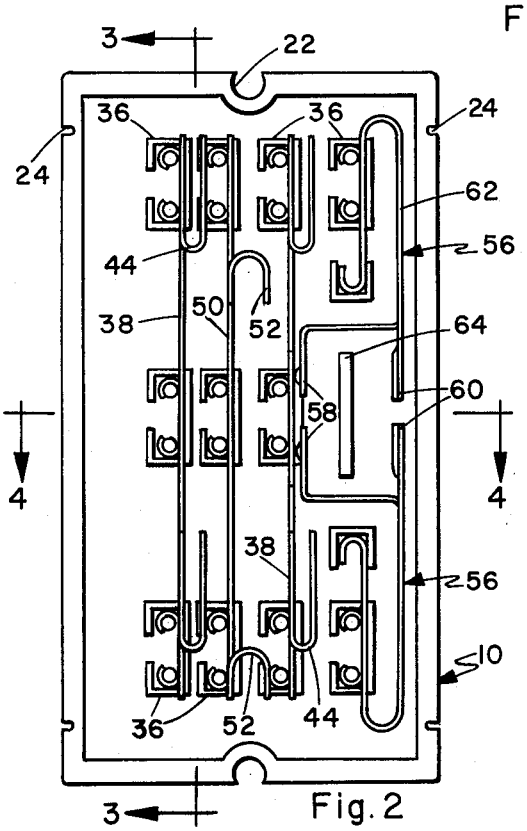
FIG. 2 is a front view of the outlet with the front plate removed.
Figure 3:
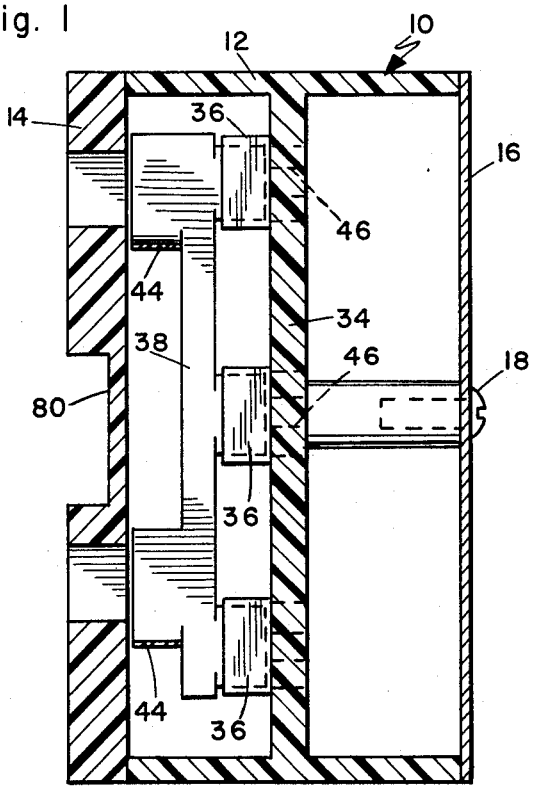
FIG. 3 is a sectional view taken on line 3—3 of FIG. 2.
Figure 4:
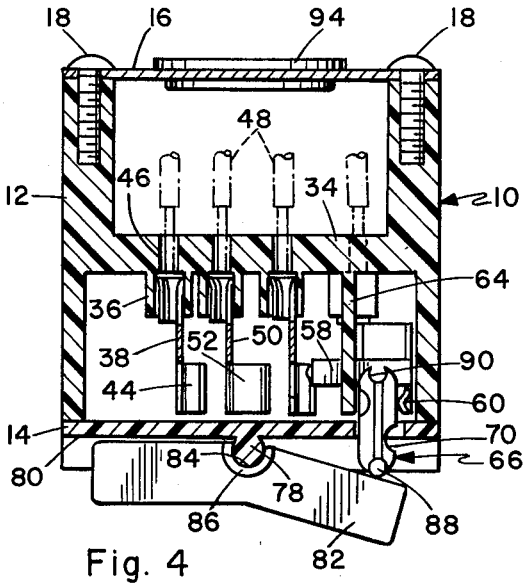
FIG. 4 is a sectional view taken on line 4—4 of FIG. 2.
Figure 5:
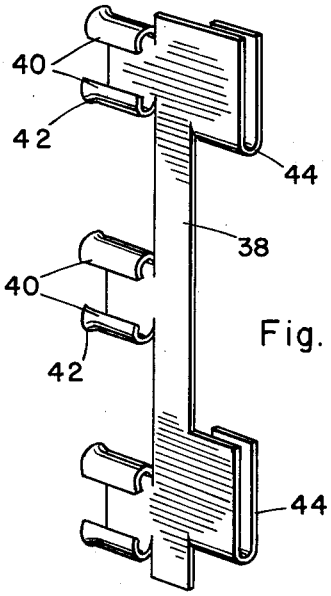
FIG. 5 is a perspective view of a typical contact element.

The casing 12 is preferably of molded plastic construction and includes a central mounting plate or wall 34 which supports the conductive structure of the assembly by means of forwardly projecting cup-like elements 36 which are molded in the plastic casing and are best shown in FIGS. 2 and 4. A typical conductive element 38 shown in FIG. 5 is formed from a single section of sheet metal and bent to define three pairs of connector sleeves 40 having slightly flared ends 42 to accept the ends of wires as will be described hereinafter, and the forward portion of the element is formed to define two sockets 44 each of which receives a prong from one of two electrical plugs. The element 18 cooperates with regard to size and spacing of the cups 36 such that the sleeve pairs 40 snuggly seat in the cups as best shown in FIG. 2, and bores 46 through the mounting wall 34 provide access and serve as guides for the insertion of wires 48 through the wall and into the sleeve.

The conductive element 38 is duplicated as shown in FIG. 2 and another conductive element 50 very similar to the others but having an enlarged socket 52 is mounted in identical fashion between the elements 38 so that the three elements together receive the prongs of two three-pronged plugs inserted through the openings 54 and the front plate 14.

Turning now to the switching function which is the salient feature of the invention, a pair of conductor strips 56 are mounted to the wall 34 in the same fashion as the other conductive elements except that these strips are each formed to define a contact 58 and a tab 60 which are made mobile and biased against the conductive element 38 by virtue of resilient spring arms 62. Thus the conductive element 38 adjacent the strip 56 provides a stationary contact conducting through the movable contact 58 when the latter are in the position illustrated in FIG. 2, but it can be seen that this contact will break when the tabs 60 are moved to the right as seen in FIG. 2.

A guide bar 64 molded integrally with the casing extends forwardly from the wall 34 and provides a surface against which a pair of cam bars 64 slide, as is most easily seen in FIG. 4. Each of these cam bars has a pair of opposite surfaces 68 which are made non-linear by means of notched or relieved areas 70, and one of these surfaces on each of the cam bars is in contact with a separate one of the tabs 60 so it can be seen that as the cam bars slide relative to the tabs, the latter will alternately be displaced away from the guide bar 64 opening the contacts and then permitted to return to the position in which the contacts touch. Several switching modes can be achieved by varying the arrangement of the cam bars in the following manner, it being assumed that the wiring of the outlet box be varied according to the mode desired. When the cam bars are moved separately, two separate switches are provided. If the bars are moved together with the sides presented to the tabs having aligned notches, a single switch is provided having a current capacity double that of either of the switches achieved in the firstmentioned mode. If the bars are moved simultaneously but the notches presented to the tabs are staggered, a switch for a dual controlled light fixture is produced.

Figure 8:
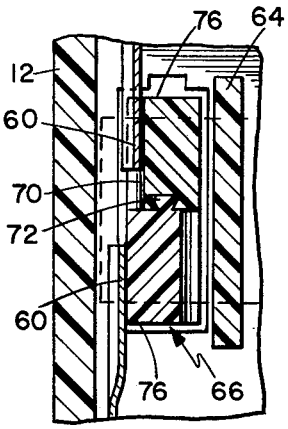
FIG. 8 is a sectional view taken on line 8—8 of FIG. 7.
Figure 10:
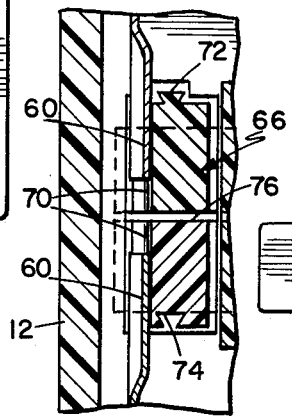
FIG. 10 is a sectional view taken on line 10—10 of FIG. 9.
Figure 9:
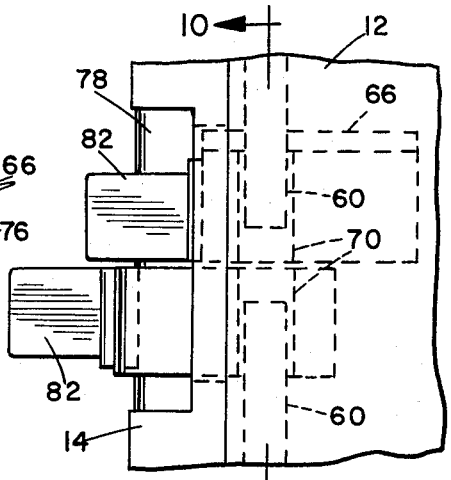
FIG. 9 is a side elevation view of a split switch arrangement.
Figure 11:
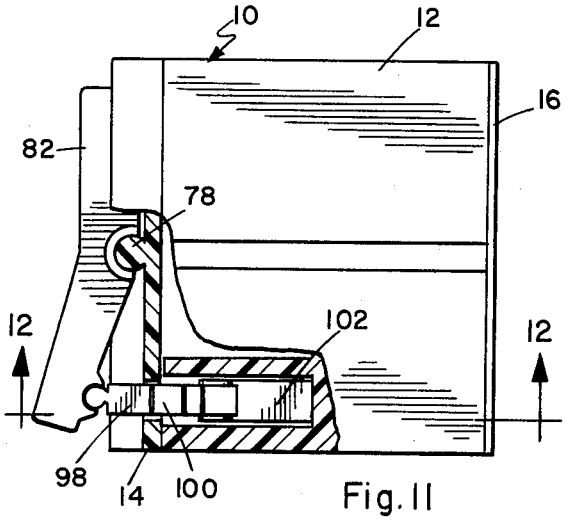
FIG. 11 is a top plan view of the unit, partially cut away, showing an alternative switch arrangement.

To enable the cam bars to be engaged together for simultaneous operation, the mating sides thereof may be provided with an expanded tongue 72 and a complementary channel 74, respectively, as shown in FIG. 8, and the sides of the cam bars opposite those mated in FIG. 8 are flat as at 76 to permit more facile independent operation in the mode illustrated in FIGS. 9 and 10.

Figure 7:
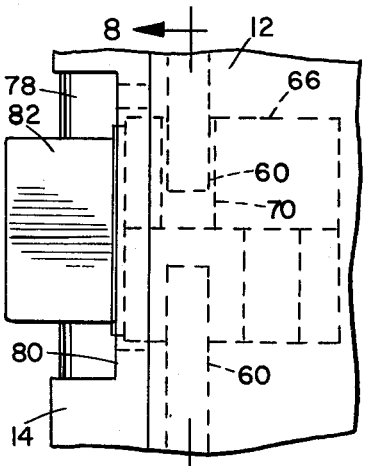
FIG. 7 is an enlarged side elevation view of the switch assembly.

Referring now to the front plate 14 of the wiring box, a vertical post 78 disposed in lateral channel 80 serves as a pivotal axis for one or two rocker arms 82 which are centrally provided with open bores 84 having resilient bushings 86 so that the rocker arm or arms may be snapped over the post 78, as shown in FIG. 4. Another vertical post 88 is mounted at one end of the V-shaped rocker arm and both ends of the cam bars define cylindrical sockets 90 so that they may be removeably snapped onto this post, as shown in FIG. 4. It can be seen from FIG. 4 that the above described sliding action of the cam bars can be effected by rocker arm movement and that in the case of simultaneous operation of the cam bars, a single rocker arm would be used as shown in FIGS. 7 and 8 and the side-by-side rocker arms illustrated in FIGS. 9 and 10 would permit independent switching action. It will be noted at this point that in order to permit the use of the alternative switching modes described and also to provide the interlocking action between the cam bars that is illustrated in FIG. 8, it is necessry that the cam bars have the sockets 90 defined in both ends so that they are reversible.

Because of the numerous connectors 40 which have been incorporated in the device, a number of separate wires may be connected so that the assembly may also serve as a junction box. To accommodate incoming wires which normally enter the box in multi-filament Romex cable, the rear plate of the wiring box as shown in FIG. 6 will have one or more knock-outs 92 to receive the cables which are subsequently expanded into separate wires as shown in FIG. 4. A split grommet 84 having inwardly projecting fingers 96 may be installed by compressing same and snapping it into place as illustrated. The fingers are resilient in nature to permit installation of the grommets, and serve to strongly secure the cables subsequent to installation.

Figure 14:
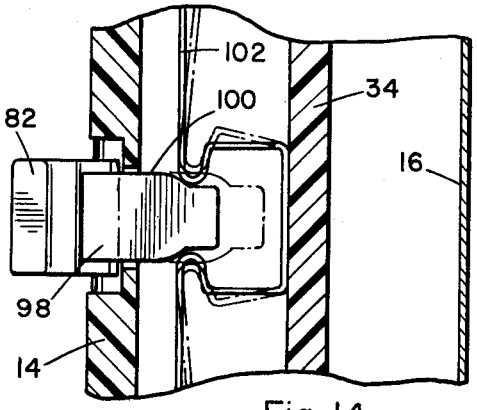
FIG. 14 is a sectional view similar to a portion of FIG. 12, showing a further switch cam configuration.
Figure 12:
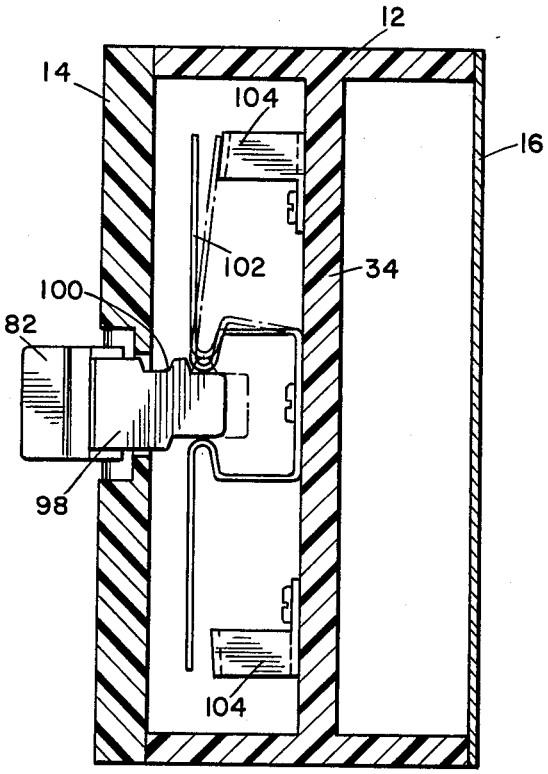
FIG. 12 is a sectional view taken on line 12—12 of FIG. 11.

FIGS. 11 through 15 illustrate a slightly modified embodiment of the invention utilizing the same principles but with a variant style of cam bar. As best seen in FIG. 12, the arrangement of the casing 12, wiring box 10, and the wiring arrangement (not shown), as well as the rocker or toggle 82 is similar to the apparatus as detailed above. The cam bar 98, however, has its operative non-linear surfaces 100 orthogonally related to the cam bars 66 and is more planar in shape. As can be seen from FIG. 12, these surfaces operate the movable contacts 102, which are shown somewhat varied from the contacts 58, to open and close circuits with stationary contacts 104 in essentially the same way that the cam bars 66 functioned. Ordinarily the cam bar 98 would be either inverted to reverse the switching function or replaced by an alternative cam bar having different functions programmed in the operative surfaces, should different switching modes be desired. It can be seen in FIG. 12 that the cam bar chosen is that utilized for a light or other appliance having dual switch control and the arrangement illustrated in FIG. 14 is a double amperage switch.

Figure 15:
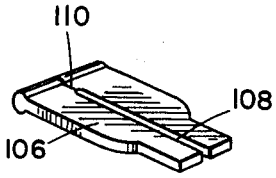
FIG. 15 is a perspective view of the switch cam of FIG. 14, modified for separation into two parts.
Figure 13:
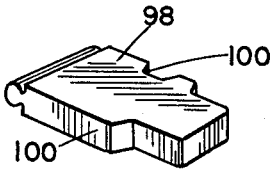
FIG. 13 is a perspective view of the switch cam of FIG. 12.

Yet a further modification of the cam bar is shown in FIG. 15 wherein a bar 106 similar to that shown in FIG. 14 is illustrated except that a slot 108 bisects the bar up to an area 110 which is solid but weakened or scored so that the two halves of the cam bar may be easily broken apart to operate independently. This, of course, would require that the toggle 82 also be split and operated along the lines of the embodiment shown in FIGS. 9 and 10. It is contemplated that several of the cam bars such as those illustrated in FIGS. 11 through 15 would be provided with every switch assembly that is marketed, the construction being so cheap that those cam bars not used could either be saved or discarded.

Although the wiring and plug receptacle functions are not illustrated in FIGS. 11 through 15 for sake of clarity, these features could be used as desired.

The assembly as described and claimed is basically simple from a manufacturing standpoint, being comprised primarily of a few molded plastic parts and formed metal strips. The switching modes are quite easily changed by simply snapping off the rocking arm and rearranging the cam bars, and any rewiring necessary is made possible by the nature of the conductor sleeves, which permit the wires to be simply withdrawn from one sleeve and reinserted in another, though the sleeves would ordinarily be of sufficiently small dimension to securely engage the wires and prevent accidental disconnection.

I claim:

1. A switch assembly comprising:
(a) a wiring box including a casing;
(b) a stationary contact mounted in said casing;
(c) a pair of movable contacts mounted in said casing and each having a tab extending therefrom and being capable of movement between a position closed with said stationary contact and a position open from said stationary contact;
(d) said contacts each having electrical connector means;
(e) a pair of slideable cam bars each having at least one non-linear surface with one portion of each surface relieved with respect to another portion of the respective surface;
(f) said tabs being biased against respective ones of said cam bars on the non-linear surfaces thereof and said cam bars each being slideably mobile generally within said casing to selectively align and disalign the respective relieved portion therein with the respective one of said tabs such that the sliding of either of said cam bars selectively effects the opening and closing of the respective movable contact;
(g) means for moving said cam bars to selectively effect the opening and closing of said movable contacts; and
(h) said moving means comprising a rocker hingedly attached to said wiring box and said cam bars being pivoted to one end of said rocker.

2. Structure according to claim 1 wherein each of said cam bars has one side thereof with means to releasibly interlock same with the other of said cam bars to effect movement of said bars in concert when interlocked.

3. Structure according to claim 2 wherein each of said cam bars has a pair of generally parallel non-linear surfaces generally orthogonally related to said one side thereof whereby said cam bars may be reversed and interlocked to effect a different switching mode.

4. Structure according to claim 2 wherein each of said cam bars has a side remote from said one side which is flat whereby upon aligning said cam bars with the flat sides together, said cam bars are independently operable.

5. Structure according to claim 4 wherein said moving means comprises a pair of rockers hinged to said wiring box and said cam bars are independently hinged to respective ones of said rockers.

6. Structure according to claim 4 wherein said rockers are parallel and coaxially hinged.

7. Structure according to claim 2 wherein one of said cam bars has an outwardly expanded tongue longitudinally extended on said one side thereof, and the other of said cam bars has a channel on said one side thereof which releasably mates with said tongue, whereby said cam bars are releasably interlocked.

8. Structure according to claim 1 wherein said pair of slideable cam bars comprise an integral unit and said integrally related cam bars are constructed with a weakened connection point such that they are easily broken apart for independent use.

9. Structure according to claim 1 wherein said rocker is removeably attached to said wiring box.

10. Structure according to claim 9 wherein said wiring box includes a removable front plate having a post mounted to the front thereof and said rocker has a lateral channel arcuate in cross section and dimensioned to snap over said post, whereby said post doubles as a pivotal axis for said rocker and as a handle for said front plate.

11. Structure according to claim 9 wherein said cam bars are removably pivoted to said rocker.

12. Structure according to claim 1 and including a mounting plate mounted in said casing, said mounting plate having a front surface and including three conductive elements mounted on said front surface, each of said conductive elements having connector means for the attachment of wires and including a conductive receptacle integral therewith to receive a bayonet terminal of an electrical plug, one of said conductive elements defining said fixed terminal.

13. Structure according to claim 12 wherein the connector means of said conductive elements each includes a pair of wirereceiving sleeves integral with the respective conductive element, and including three forwardly extended cups mounted on said forward face, each of said cups receiving in seated relationship one of said sleeve pairs, and said mounting plate having a plurality of bores therethrough, each of said bores being aligned with one of said sleeves so that said connector means can be wired by the insertion of wires through said mounting plate from the rear and into said sleeves.

14. A switch assembly comprising:
(a) a wiring box including a casing;
(b) a stationary contact mounted in said casing;
(c) a movable contact mounted in said casing and having a tab extending therefrom and being capable of movement between a position closed with said stationary contact and a position open from said stationary contact;
(d) said contacts each having electrical connector means;
(e) a slideable cam bar having at least one non-planar surface with one portion of the surface relieved with respect to the remaining portions of said surface;
(f) said tab being biased aganst said cam bar on said non-linear surface and said cam bar being slideably mobile to selectively align and disalign the relieved portion therein with said tab such that the sliding of said cam bar selectively effects the opening and closing of said movable contact; and
(g) a rocker hingedly attached to said wiring box, said cam bar being pivoted to one end of said rocker whereby movement of said rocker slideably moves said cam bar with respect to said tab to effect the opening and closing of said movable contact.

* * * * *